US005983456A

United States Patent [19]

Leifeld

[11] Patent Number: 5,983,456

[45] Date of Patent: Nov. 16, 1999

[54] SLIVER GUIDING DEVICE FOR A FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 09/148,629

[22] Filed: Sep. 4, 1998

[30] Foreign Application Priority Data

Sep. 8, 1997 [DE] Germany ..... 197 39 188
May 27, 1998 [DE] Germany ..... 198 23 571

[51] Int. Cl.[6] ..... D01G 25/00

[52] U.S. Cl. ..... 19/150; 19/239; 19/288

[58] Field of Search ..... 19/150, 157, 236, 19/239, 287, 288, 291, 292

[56] References Cited

U.S. PATENT DOCUMENTS

| | | | |
|---|---|---|---|
| 1,926,475 | 9/1933 | Casablancas | 19/292 |
| 1,992,121 | 2/1935 | Casablancas | 19/292 |
| 3,387,339 | 6/1968 | Bofill | 19/150 |
| 4,630,336 | 12/1986 | Schopwinkel et al. | 19/150 |
| 5,829,101 | 11/1998 | Denz et al. | 19/288 |

FOREIGN PATENT DOCUMENTS

| | | | |
|---|---|---|---|
| 2 271 312 | 12/1975 | France . | |
| 25 20 016 | 11/1975 | Germany . | |
| 27 32 016 | 2/1979 | Germany . | |
| 28 36 979 | 3/1980 | Germany . | |
| 38 07 582 | 9/1989 | Germany . | |
| 281 825 | 8/1990 | Germany . | |
| 41 36 209 | 6/1993 | Germany . | |
| 577094 | 5/1946 | United Kingdom . | |
| 614958 | 12/1948 | United Kingdom | 19/291 |
| 682208 | 11/1952 | United Kingdom | 19/291 |
| 722954 | 2/1955 | United Kingdom . | |
| 796939 | 6/1958 | United Kingdom . | |
| 849975 | 9/1960 | United Kingdom . | |
| 1513743 | 6/1978 | United Kingdom . | |

*Primary Examiner*—Michael A. Neas
*Assistant Examiner*—Gary L. Welch
*Attorney, Agent, or Firm*—Venable; Gabor J. Kelemen

[57] ABSTRACT

A fiber processing machine includes a sliver guiding device having first and second wall elements as well as first, second, third and fourth wall faces. The first and second wall faces which form part of the first and second wall elements, respectively, are oriented toward and spaced from one another to define a first gap. The third and fourth wall faces are oriented toward and spaced from one another to define a second gap. Some of the wall faces are convergent for densifying a sliver running through the first and second gaps. At least one of the first and second wall elements is stationary during operation. First and second cooperating withdrawing rolls immediately adjoin the first gap for pulling the sliver therethrough upon their rotation. The first and second withdrawing rolls define a bight into which the first and second wall faces extend. The first and second withdrawing rolls have respective first and second circumferential roll surface portions forming the bight. The first and second circumferential roll surface portions constitute, respectively, the third and fourth wall faces of the sliver guiding device.

21 Claims, 7 Drawing Sheets

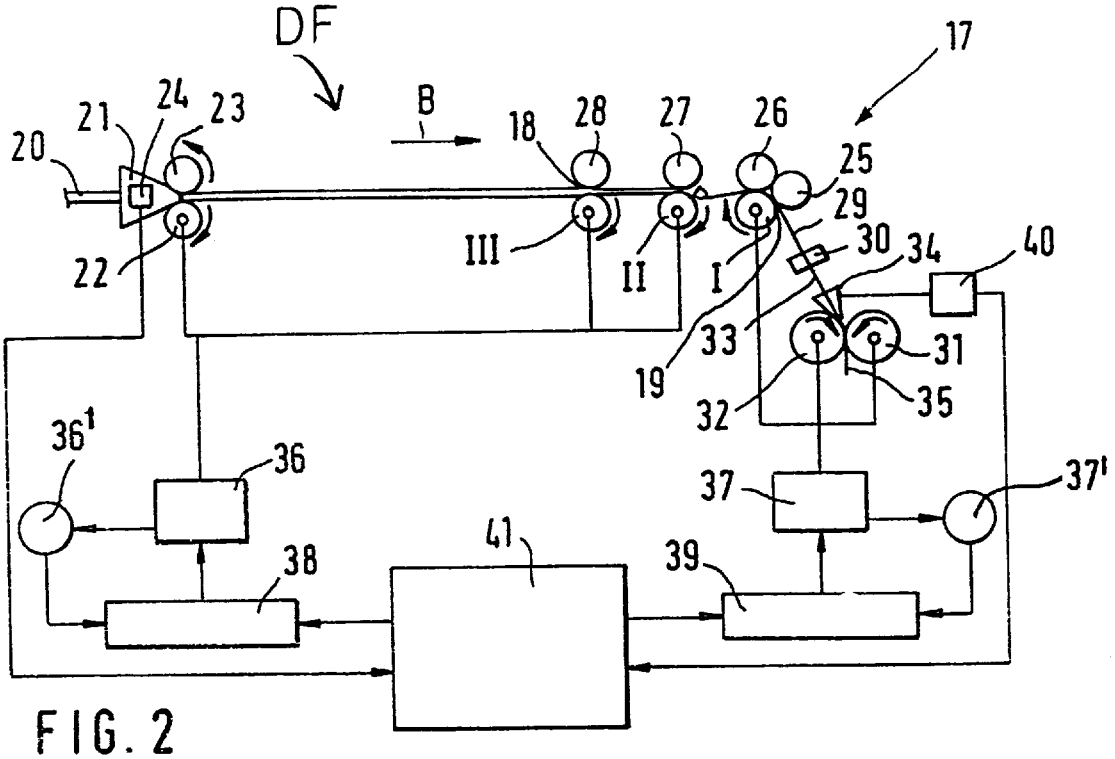
FIG. 2
FIG. 3
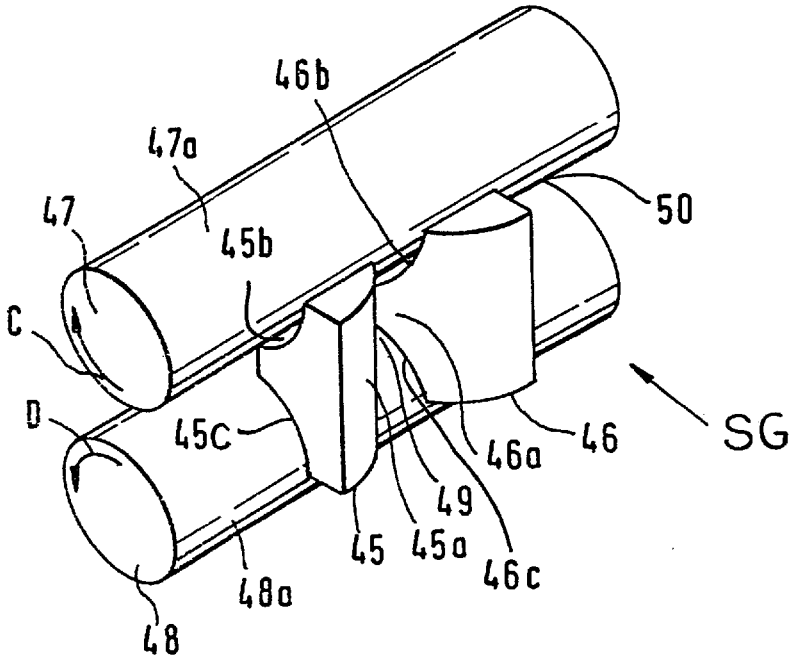

FIG. 4a
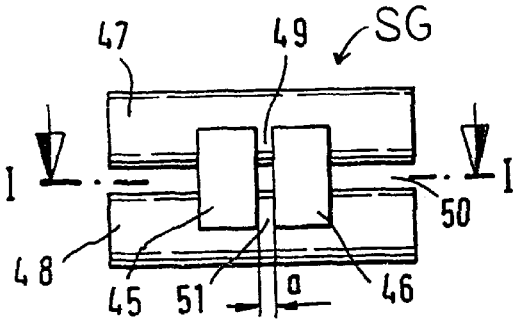
FIG. 4b
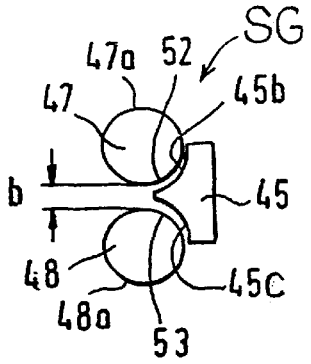
FIG. 4c
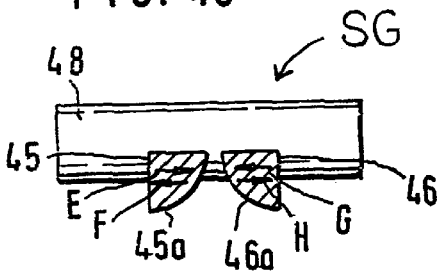
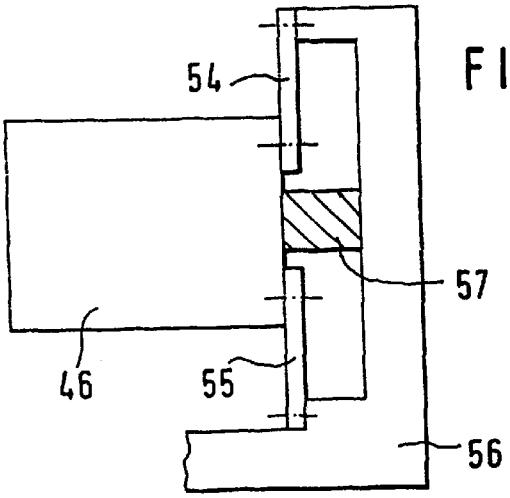
FIG. 5

SLIVER GUIDING DEVICE FOR A FIBER PROCESSING MACHINE

CROSS REFERENCE TO RELATED APPLICATION

This application claims the priority of German Application Nos. 197 39 188.5 filed Sep. 8, 1997 and 198 23 571.2 filed May 27, 1998, which are incorporated herein by reference.

BACKGROUND OF THE INVENTION

This invention relates to a sliver guiding device for a fiber processing machine, particularly a card or a drawing frame and is of the type that has at least one immovable guide wall for guiding a sliver (single or multiple) running therethrough. The walls of the sliver guiding device converge (for example, conically) at least in part and are structured to gather the material of the sliver. At the downstream end of the sliver guiding device (as viewed in the direction of sliver run) a rotatable withdrawing roll pair having cylindrical surfaces is provided. The guide walls of the sliver guiding device project into the bight which is formed by the two rolls of the roll pair and which terminates in the nip of the roll pair.

At the outlet of a carding machine the gathered fiber web is introduced into a sliver forming web trumpet having conically converging inner wall faces and the thus-densified sliver is continuously pulled out of the web trumpet. At the outlet end of a drawing frame the drawn slivers too, are introduced into a sliver trumpet of conically converging inner walls and the sliver is pulled out as a densified sliver. In each instance the sliver trumpet is a one-piece component.

According to a known arrangement, at the input of a drawing frame a sliver guide for a plurality of slivers is provided, the outlet of which extends to the nip of the withdrawing rolls. Two walls of the sliver guide are conically converging. The sliver guide is a one-piece component and has two side walls, a top wall and a bottom wall. It is a disadvantage of this conventional arrangement that the sliver frictionally slides along all sides of the immovable wall faces. Because of the closed configuration of the sliver guide, a lateral yielding of the sliver is not possible. Also, a release of air which escapes from the running sliver as a result of its compression by the trumpet is possible only through the inlet and outlet of the trumpet. It is a further drawback that when the sliver number is changed, due to the rigid, immovable walls, an adaptation of the sliver guide is rendered more difficult. Also, threading of the slivers into and through the sliver guide is time-consuming and labor-intensive when practiced with conventional devices.

SUMMARY OF THE INVENTION

It is an object of the invention to provide an improved sliver guiding device of the above-outlined type from which the discussed disadvantages are eliminated and which, in particular, makes possible a flexible adaptation and an improved gathering of the running sliver in the working direction.

This object and others to become apparent as the specification progresses, are accomplished by the invention, according to which, briefly stated, a fiber processing machine includes a sliver guiding device having first and second wall elements as well as first, second, third and fourth wall faces. The first and second wall faces which form part of the first and second wall elements, respectively, are oriented toward and spaced from one another to define a first gap. The third and fourth wall faces are oriented toward and spaced from one another to define a second gap. Some of the wall faces are convergent for densifying a sliver running through the first and second gaps. At least one of the first and second wall elements is stationary during operation. First and second cooperating withdrawing rolls immediately adjoin the first gap for pulling the sliver therethrough upon their rotation. The first and second withdrawing rolls define a bight into which the first and second wall faces extend. The first and second withdrawing rolls have respective first and second circumferential roll surface portions forming the bight. The first and second circumferential roll surface portions constitute, respectively, the third and fourth wall faces of the sliver guiding device.

By providing that the movable circumferential surfaces of the two rotating withdrawing rolls form two wall faces of the sliver guiding mechanism, the friction between the sliver guiding device and the sliver is reduced. Further, the invention makes possible a lateral yielding of the sliver, providing for a flexible adaptation. It is further advantage that the air exiting from the sliver as a result of its compression may escape through the open regions. Also, threading the sliver into and through the sliver guiding mechanism is significantly simplified and may be performed rapidly. The simpler and more rapid insertion of a new sliver reduces operational interruptions and thus permits a greater productivity.

The invention has the following additional advantageous features:

- The lateral walls converge conically.
- The lateral walls have a bent guiding surface.
- At least one of the lateral walls is immovable during operation.
- The distance between the lateral walls is adjustable.
- The plane passing through the roll nip between the withdrawing rolls and the plane passing through the clearance between the lateral walls are perpendicular to one another.
- The lateral walls are independent from one another.
- The lateral walls include a profiled (for example, extruded) member.
- The lateral walls are spring-biased, for example, by a leaf spring, compression spring or tension spring.
- The inner wall faces of the sliver guiding mechanism are formed of two circumferential surfaces of the withdrawing rolls and two bent surfaces of the lateral walls.
- At least one lateral wall is shiftable.
- At least one lateral wall is pivotal, for example, about a rotary joint.
- The lateral walls are supported in a housing.

The invention may find application in a fiber processing machine, particularly a carding machine or a drawing frame wherein the sliver guiding mechanism is formed of at least one guide element for guiding a single or multiple sliver. The lateral walls of the sliver guide are conically converging, and at the outlet of the sliver guide a withdrawing roll pair is provided. The lateral walls extend to the roll nip. Further, for measuring the thickness of the sliver, a mechanically contacting measuring member is provided, and the top and bottom walls of the sliver guide are formed by the circumferential surfaces of the withdrawing rolls. The measuring member cooperates with at least one of the side walls. Advantageously, the measuring member executes only small excursions and includes a piezoelectric pressure sensor. As an alternative, the measuring member comprises expansion strips and is path-dependent. Further, an inductive measuring member, for example, a plunger coil with a plunger core is provided. The upper surface of the withdrawing rolls is advantageously profiled, for example, scored or roughened. In this manner, the grasping and the advancing of the sliver are improved.

BRIEF DESCRIPTION OF THE DRAWINGS

FIG. 2 is a schematic side elevational view, with block diagram, of a drawing frame incorporating the sliver guiding and measuring device according to the invention.

FIG. 3 is a perspective view of a preferred embodiment of the invention.

FIGS. 4*a,* 4*b* and 4*c* are respective rear elevational, side elevational and sectional top plan views of the construction shown in FIG. 3.

FIG. 5 is a rear elevational view illustrating a supporting mechanism of a wall element of the structure according to the invention.

DESCRIPTION OF THE PREFERRED EMBODIMENTS

Figure 1:
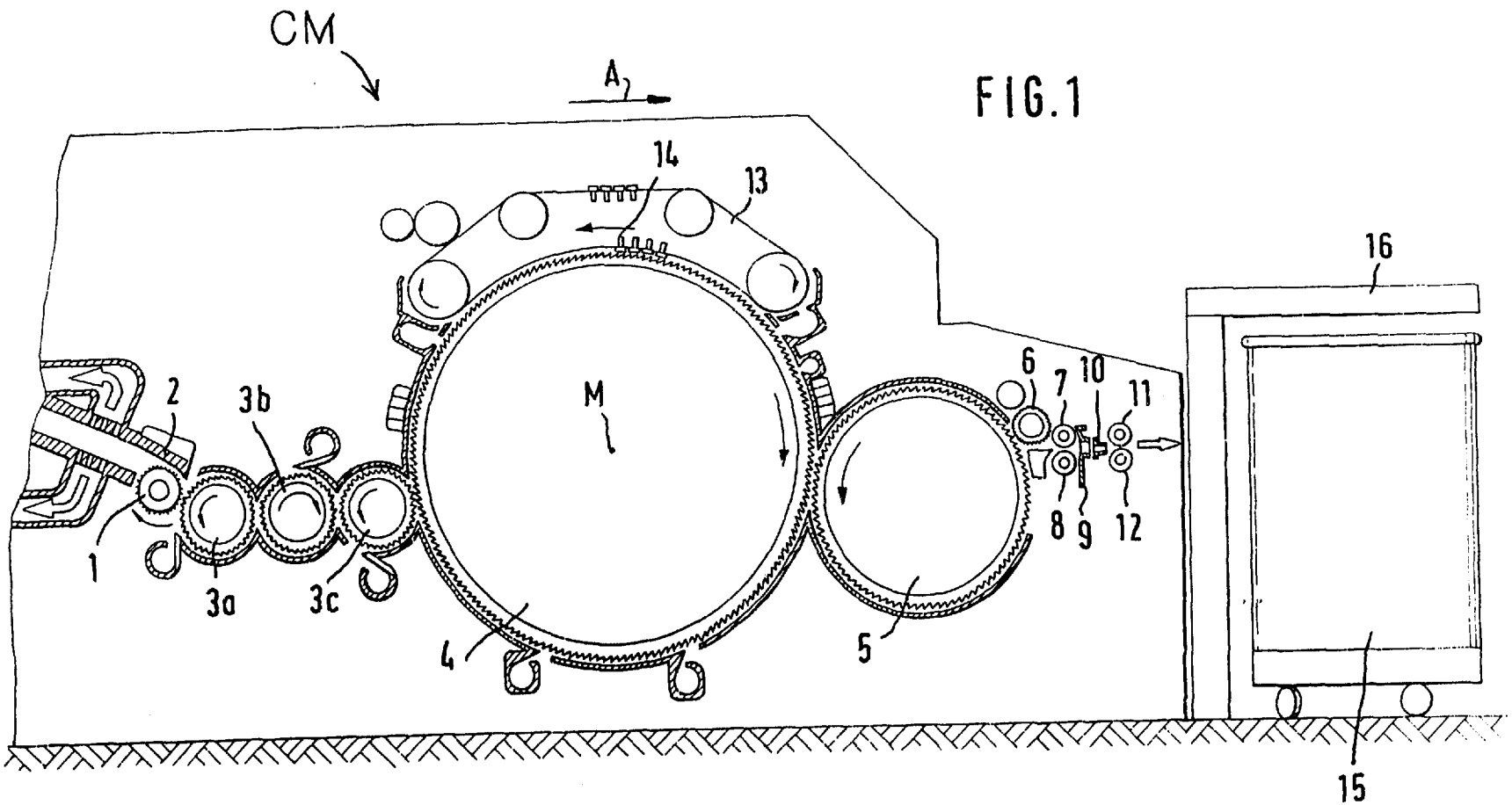
FIG. 1 is a schematic side elevational view of a carding machine incorporating the device according to the invention.

FIG. 1 shows a carding machine CM which may be, for example, an EXACTACARD DK 803 model, manufactured by Trützschler GmbH & Co. KG, Mönchengladbach, Germany. The carding machine CM has a feed roll 1, a feed tray 2 cooperating with the feed roll 1, licker-ins 3*a,* 3*b* and 3*c,* a main carding cylinder 4, a doffer 5, a stripper roll 6, crushing rolls 7, 8, a web guiding element 9, a sliver trumpet 10, withdrawing (calender) rolls 11, 12, travelling flats 13 including flat bars 14, a coiler can 15 and a sliver coiler 16. The direction of rotation of the various rolls is designated with curved arrows. The top and bottom surfaces of the sliver trumpet 10 are, according to the invention, constituted by the circumferential surfaces of the calender rolls 11, 12.

FIG. 2 illustrates a drawing frame DF which may be an HSR model manufactured by Trützschler GmbH & Co. KG. The drawing frame DF has a drawing unit 17 flanked upstream and downstream by a drawing unit inlet 18 and a drawing unit outlet 19, respectively. The sliver 20 is withdrawn from coiler cans and enters the sliver guide 21 and is thereafter pulled therethrough by cooperating withdrawing rolls 22, 23 to cause the sliver 20 to run past the measuring member 24. The drawing unit 17 is a four-over-three drawing unit, that is, it has a lower output roll I, a lower mid roll II and a lower input roll III as well as four upper rolls 25, 26, 27 and 28. In the drawing unit 17 a drawing (stretching or drafting) of the sliver 20 takes place. The drawing unit has preliminary and principal drawing fields. The roll pairs 28/III and 27/II constitute the preliminary drawing field while the roll pair 27/II and the roll unit 25, 26/I form the principal drawing field. At the drawing unit outlet 19 the drawn sliver 29 reaches a sliver guide 30 and is pulled through a sliver trumpet 34 by means of withdrawing rolls 31, 32 and, if there are a plurality of slivers, these are combined into a single sliver 35 which is subsequently deposited into coiler cans.

The withdrawing rolls 31, 32, the lower intake roll III and the lower mid roll II which are coupled to one another mechanically, for example, by a toothed belt, are driven by a regulating motor 36 with a pre-inputted desired value. The upper rolls 28 and 27 are driven by friction from the respective lower rolls III and II. The lower output roll I and the withdrawing rolls 31, 32 are driven by a main motor 37. The regulating motor 36 and the main motor 37 are provided with a respective regulator 38 and 39. The rpm regulation is effected by means of a closed regulating circuit in which a tachometer 36' is coupled with the regulator 38 and a tachometer 37' is coupled with the regulator 39. At the drawing unit inlet 18 a magnitude of the sliver which is proportional to the sliver mass, such as its cross section, is measured by an inlet measuring organ 24. At the drawing unit outlet 19 the cross section of the exiting sliver 35 is determined by a sliver outlet measuring organ 40 associated with a sliver trumpet 34. The top and bottom surfaces of the sliver trumpet 34 are formed by the circumferential surfaces of the withdrawing rolls 31, 32.

A central computer unit 41 (control-and-regulating device), such as a microcomputer or a microprocessor transmits to the regulator 38 a setting of the desired magnitude for the regulating motor 36. The measuring magnitudes of the two measuring members 24 and 40 are applied to the central computer unit 41 during the sliver drawing process. The central computer unit 41 determines the desired value for the regulating motor 36 from the measuring values of the inlet measuring member 24 and from the desired value for the cross section of the exiting sliver 35. The measuring values of the outlet measuring member 40 serve for monitoring the exiting sliver 35. With the aid of such a regulating system fluctuations in the cross section of the inputted sliver 20 may be compensated for by a suitable regulation of the drawing process and thus an evening of the outputted sliver 35 may be achieved.

As shown in FIGS. 3, 4*a,* 4*b* and 4*c,* a sliver guiding device SG has two shaped wall elements 45 and 46 which are spaced from one another to define a vertical gap 49 having a width a. The wall faces 45*a* and 46*a* oriented toward one another are of convex, converging configuration to thus gather the non-illustrated sliver (sliver bundle) passing through the gap 49. The wall elements 45 and 46 are immediately adjoined by two cooperating withdrawing rolls 47, 48 which form part of the sliver guiding device SG and which rotate in the direction of the respective arrows C and D. The wall faces 45*b* and 45*c* of the wall element 45 and the wall faces 46*b* and 46*c* of the wall element 46 face the rolls 47, 48 and have a concave curvature. The withdrawing rolls 47, 48 are spaced from one another to define a horizontal gap 50 having a width b as shown in FIG. 4*b*. An imaginary plane passing through the gap 49 and separating the wall elements 45, 46 and an imaginary plane passing through the gap (roll clearance) 50 and separating the withdrawing rolls 47, 48 are oriented perpendicularly to one another. The two lateral surfaces of the sliver guiding mechanism are formed by the operationally stationary wall faces 45*a* and 46*a* of the respective wall elements 45 and 46, whereas the top and bottom surfaces of the sliver guiding mechanism are formed by the operationally movable circumferential surfaces 47*a* and 48*a* of the withdrawing rolls 47 and 48.

As shown in FIG. 4*a*, the gaps 49 and 50 form an outlet opening 51 for the sliver bundle. According to FIG. 4*b*, between the concave surface 45*b* of the wall element 45 and the convex surface 47*a* of the roll 47 and between the concave surface 45*c* of the wall element 45 and the convex surface 48*a* of the roll 48 respective gaps 52, 53 are formed which widen in the direction of the gap 50 defined between the rolls 47 and 48. In this manner, a clamping or jamming of the fiber material in the gap 52 or 53 is avoided.

In FIG. 4*c*, the operationally stationary wall elements 45, 46 are displaceable, by linear or pivotal motion, in the direction of the arrows E, F and G, H, respectively. As a result, the gap 49 is widened and thus the gap 50 becomes accessible for threading through new fiber material. The fiber guiding device SG may be used for splicing together two overlapping sliver ends by applying pressure thereto by the device SG as they pass therethrough. For this purpose, the wall element 45 is moved away in the direction of the arrow F from the wall element 46, the end of one sliver is drawn through the gap 50 and superposed on the end of the other sliver end. Then the wall element 45 is moved back towards the wall element 46 in the direction E and thereafter the withdrawing rolls 47, 48 are rotated. As a result, the splicing location of the slivers passes through the sliver guide SG and exits at the gap 50. The radii of curvature of the immovable bent wall faces 45*a*, 46*a* may be adapted to the movable wall faces 47*a* and 48*a* because of the different extent of wall friction.

According to FIG. 5, the wall element 46 is articulated to a frame 56 by two leaf springs 54 and 55. The free ends of the leaf springs 54 and 55 are attached to the wall element 46 and define a space in which a low-excursion measuring member 57, such as a piezoelectric pressure sensor, expansion strips or the like are disposed such that they are coupled with the wall element 46 and the frame 56.

Figure 6:
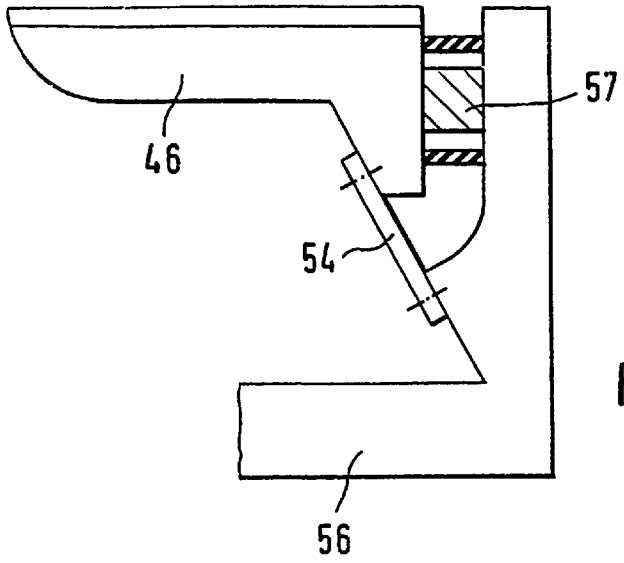
FIG. 6 is a top plan view of a variant of FIG. 5.

In FIG. 6, the wall element 46 is elastically supported on the frame 56 by a leaf spring 54.

Figure 7:
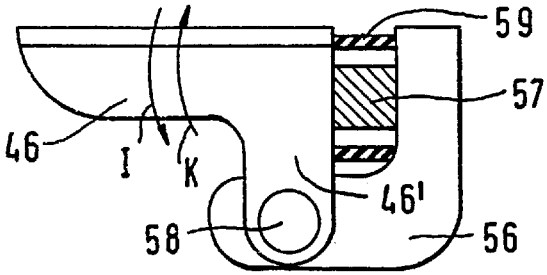
FIG. 7 is a top plan view of another variant for supporting a wall element.

In FIG. 7, the wall element 46 is of angled shape and is articulated to the frame 56 by a pivot 58. The low-excursion measuring member 57 allows for an extremely small swinging motion of the wall element 46 so that in operation between the two wall elements 45 and 46 (FIG. 3) the gap 49 is maintained at a substantially constant width. Upon pressure fluctuations of the fiber material in the gap 49 as the sliver runs therethrough, the reaction force of the sliver applied to the wall element 46 and transmitted to the wall element arm 46' changes, and such a change is transmitted to the measuring member 57 and converted into electric pulses. The excursion-poor (or excursion-less) pressure sensitive measuring member 57, such as expansion strips or a piezocrystal, senses particularly high-frequency signal components. For a carding machine a frequency range of up to approximately 50 Hz, and for a drawing frame a frequency range of up to approximately 2 KHz may be utilized. The measuring member 57 is surrounded by a sealing bushing 59 made, for example, of rubber.

Figure 8:
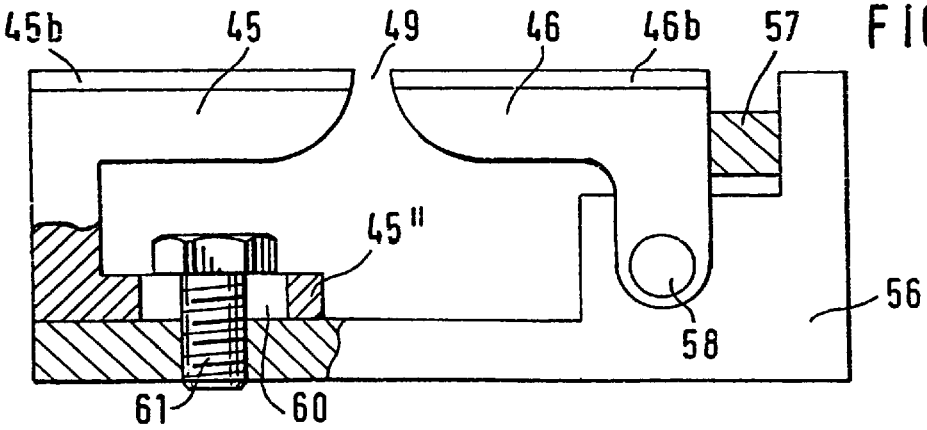
FIG. 8 is a top plan view of a structure having a wall element pivotally supported as in FIG. 7 and a further, operationally stationary but adjustable second wall element.

In FIG. 8, the wall element 45 is of approximately U-shaped configuration and has a leg 45" which is secured to the frame 56 by means of a screw 61 passing through a slot 60 of the wall element 45, whereby the latter is adjustable towards and away from the wall element 46 to thus vary the width of the gap 49. The wall element 46 constitutes the measuring side structured similarly to the arrangement shown in FIG. 7.

Figure 9:
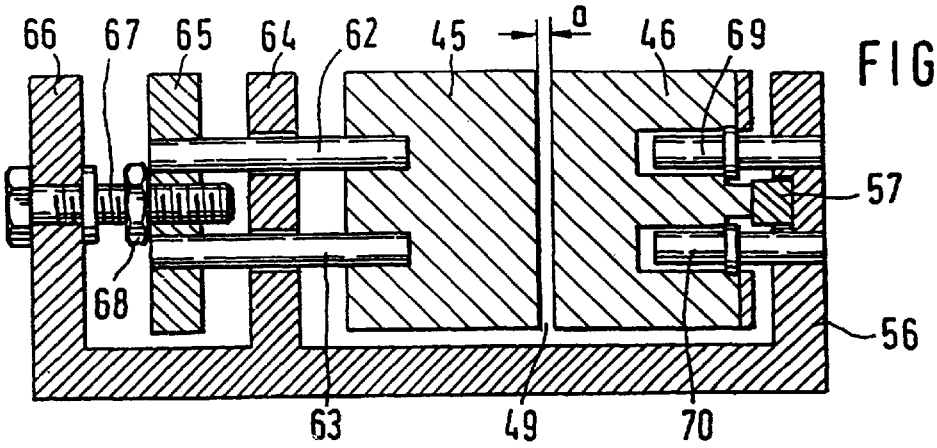
FIG. 9 is a sectional rear elevational view of yet another embodiment showing adjustable wall elements.

According to FIG. 9, the low-excursion wall element 46 is in engagement with the low-excursion measuring member 57. The wall element 45 is secured to holding bars 62, 63 which pass through openings of a stationary guide element 64 and are affixed to a movable holding element 65. Parallel to the guide element 65 a supporting element 66 is provided which is part of the frame 56. A setscrew 67 passes through the thread in the supporting element 66 and threadedly engages the holding element 65, so that by turning the setscrew 67 the width a of the gap 49 may be varied. The set position of the wall element 45 may be immobilized by a counternut 68. There are further provided holding elements 69, 70 which support the wall element 46 and which absorb transverse forces.

Figure 10:
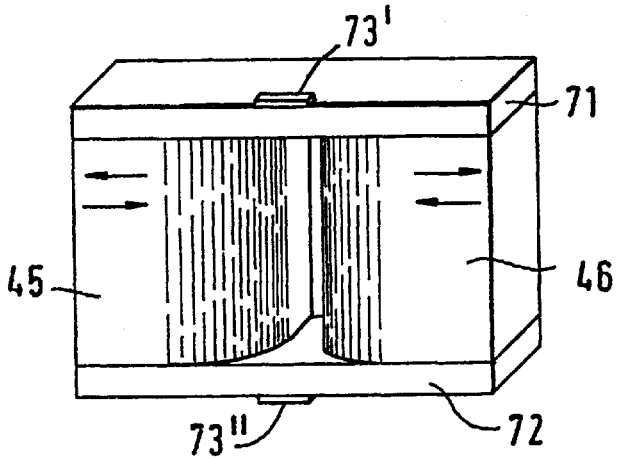
FIG. 10 is a perspective view of wall elements disposed jointly in a common holding device.

In FIG. 10, the wall elements 45, 46 are together disposed in a holding device which has plate-like upper and lower holding elements 71, 72, respectively. In operation the wall elements 45 and 46 are substantially stationary. The wall elements 45, 46, however, are not rigidly affixed to the holding elements 71 and 72 so that a relative motion—although of small extent—may occur between the wall elements 45, 46 and the holding elements 71, 72. The holding elements 71, 72 are connected with respective low-excursion measuring members (for example, expansion strips) 73' and 73".

Figure 11:
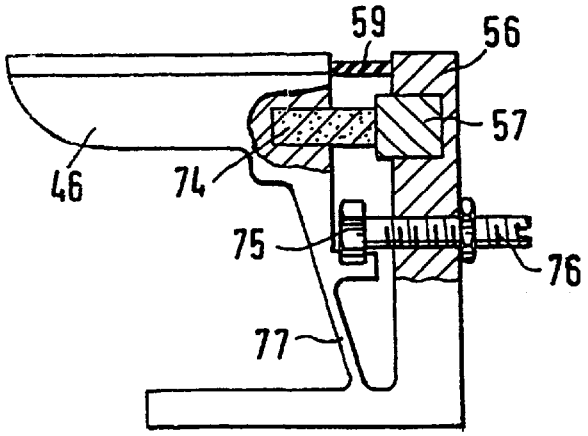
FIG. 11 is a top plan view, partially in section, of a wall element and its support according to yet another embodiment of the invention.

In the embodiment according to FIG. 11, to the frame 56 a low-excursion measuring member 57 is attached which is supported on the wall element 46 by a connecting element 74 made, for example, of a sintered ceramic material or the like. A spacer element formed essentially of an adjustable abutment 75 and a setscrew 76 protects the measuring member 57 particularly from excessive mechanical stresses. An elastic connecting element 77, such as a leaf spring, supports the wall element 46 on the frame 56.

Figure 12:
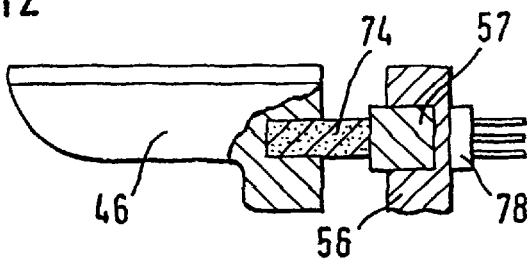
FIG. 12 is a sectional top plan view of a wall element including a cooling element associated with a measuring member.

In FIG. 12, the measuring member 57 is coupled with a cooling member 78, such as a Peltier element.

Figure 13:
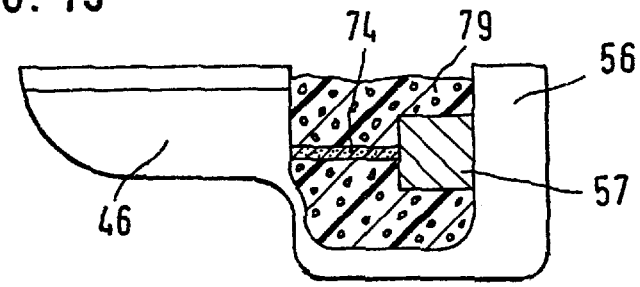
FIG. 13 is a partially sectional top plan view of an embodiment similar to FIG. 11, including a filling mass.

In FIG. 13, between the wall element 46 and the measuring member 57 a heat insulating pressure bar 74 is provided which may be made of ceramic, a carbon fiber composite material or the like. The space between the wall element 46 and the frame 56 in which the measuring member 57 and the pressure bar 74 are disposed, is filled with a mass 79 such as a cast foam mass, for example, silicone foam.

Figure 14:
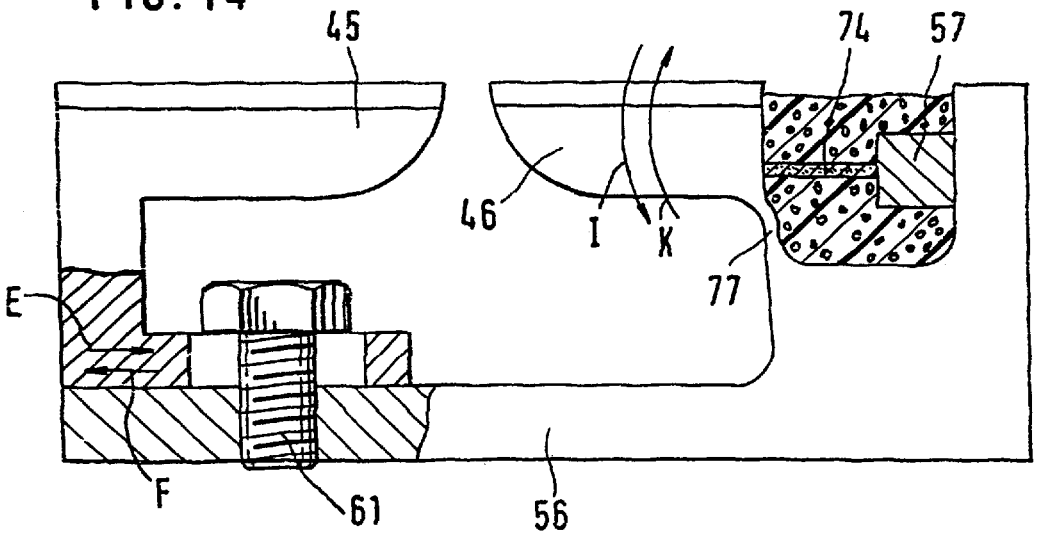
FIG. 14 is a partially sectional top plan view similar to FIG. 8, showing an elastic connection and a heat insulating element between one wall element and a frame.

In FIG. 14, the wall element 45 is displaceable in the direction of the arrows E, F and may be immobilized by a setscrew 61 threaded into the frame 56. The wall element 46 is movable to a very small extent in the direction of the arrows I, K and corresponds to the FIG. 13 embodiment. The construction may also include a spacer element as shown at 75, 76 in FIG. 11.

Figure 15:
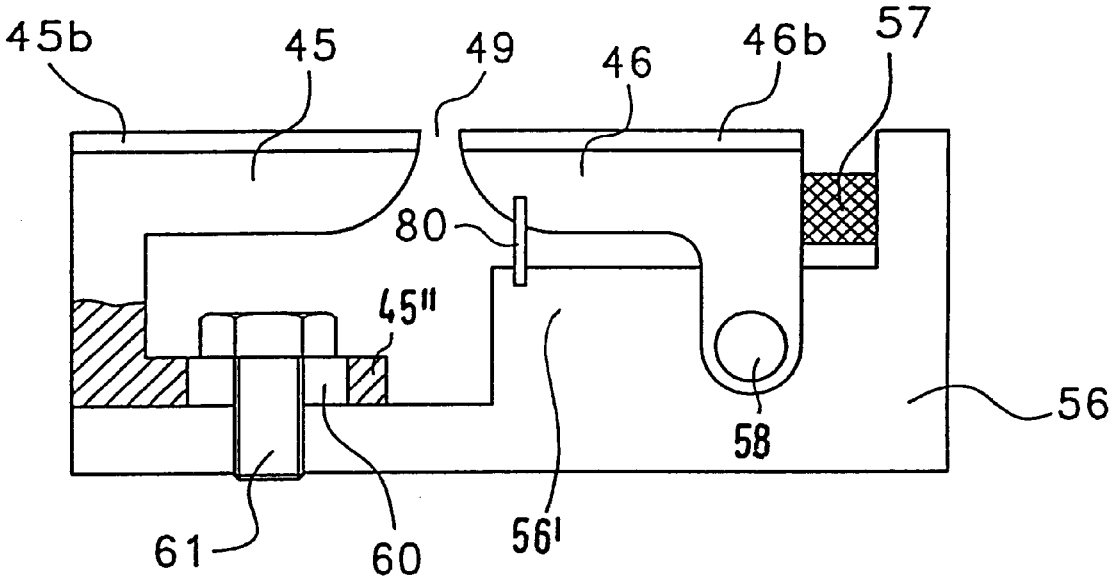
FIG. 15 is a partially sectional top plan view of another preferred embodiment.
Figure 16:
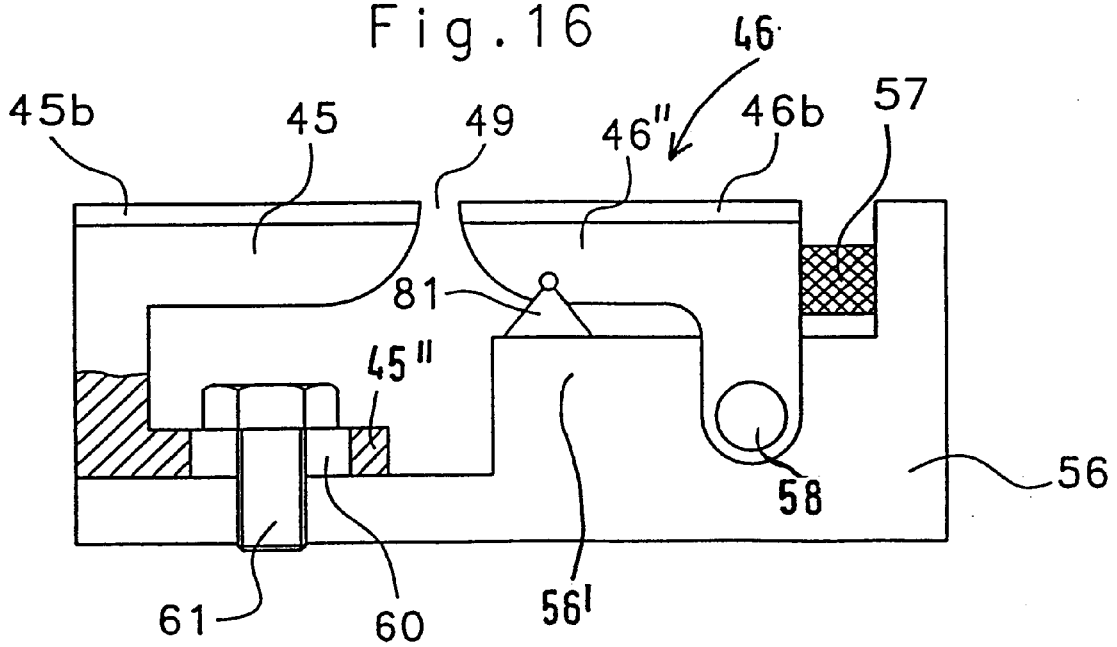
FIG. 16 is a partially sectional top plan view of yet another preferred embodiment.

The embodiments shown in FIGS. 15 and 16 are similar to the construction illustrated in FIG. 8. In both embodiments shown in FIGS. 15 and 16 the frame 56 has an extension 56' which is situated underneath the free end of the arm 46" of the wall element 46 to thus serve as a support for a compensating element coupling the wall element 46 to the frame extension 56' at a location spaced from the pivot 58 by means of which the wall element 46 is mounted on the frame 56. In the FIG. 15 embodiment the compensating element is a leaf spring 80, whereas in the FIG. 16 embodiment the compensating element is a rotary joint 81.

It will be understood that the above description of the present invention is susceptible to various modifications, changes and adaptations, and the same are intended to be comprehended within the meaning and range of equivalents of the appended claims.

What is claimed is:

1. In a fiber processing machine including a sliver guiding device having first and second wall elements, first, second, third and fourth wall faces; said first and second wall faces forming part of said first and second wall elements, respectively and being oriented toward and spaced from one another to define a first gap; said third and fourth wall faces being oriented toward and spaced from one another to define a second gap; some of said wall faces being convergent for densifying a sliver running through said first and second gaps; at least one of said first and second wall elements being stationary during operation; and first and second cooperating withdrawing rolls immediately adjoining said first gap for pulling the sliver therethrough upon rotation of said first and second withdrawing rolls; said first and second withdrawing rolls defining a bight into which said first and second wall faces extend;

the improvement wherein said first and second withdrawing rolls have respective first and second circumferential roll surface portions forming said bight; said first and second circumferential roll surface portions constituting, respectively, said third and fourth wall faces of said sliver guiding device.

2. The improvement as defined in claim 1, further comprising means for adjusting a width of said first gap.

3. The improvement as defined in claim 1, wherein a plane passing between said first and second wall elements through said first gap is perpendicular to a plane passing between said first and second withdrawing rolls through said second gap.

4. The improvement as defined in claim 1, wherein said first and second wall elements are independent from one another.

5. The improvement as defined in claim 1, wherein said first and second withdrawing rolls are horizontally oriented and vertically superposed; further wherein said first and second wall faces are lateral wall faces and said third and fourth wall faces are respective top and bottom wall faces of said sliver guiding device.

6. The improvement as defined in claim 1, further comprising a frame and a spring resiliently supporting one of said first and second wall elements on said frame for allowing displacements of said one wall element in response to thickness fluctuations of the sliver passing through said sliver guiding device.

7. The improvement as defined in claim 1, further comprising a frame and means for linearly shiftably supporting one of said first and second wall elements on said frame.

8. The improvement as defined in claim 1, further comprising a frame and means for pivotally supporting one of said first and second wall elements on said frame.

9. The improvement as defined in claim 1, further comprising a common housing accommodating and supporting said first and second wall elements.

10. The improvement as defined in claim 1, wherein said fiber processing machine is a carding machine having an outlet; said sliver guiding device constituting a sliver forming web trumpet disposed at said outlet.

11. The improvement as defined in claim 1, wherein said fiber processing machine is a drawing frame having an outlet; said sliver guiding device constituting a sliver trumpet disposed at said outlet.

12. The improvement as defined in claim 1, further comprising a sliver thickness measuring device including a pressure sensitive member connected to said first wall element for responding to excursions thereof caused by thickness fluctuations of the sliver running through said sliver guiding device.

13. The improvement as defined in claim 12, wherein said pressure sensitive member comprises a piezoelectric crystal.

14. The improvement as defined in claim 12, wherein said pressure sensitive member comprises expansion strips.

15. The improvement as defined in claim 12, further comprising a heat insulating member positioned between said first wall element and said pressure sensitive member.

16. The improvement as defined in claim 12, further comprising a cooling member operatively connected with said pressure sensitive member.

17. The improvement as defined in claim 12, further comprising a cast mass embedding said pressure sensitive member.

18. The improvement as defined in claim 12, further comprising a frame and a holding element; said pressure sensitive member being positioned between said frame and said first wall element; said holding element supporting said pressure sensitive member on said frame; and said holding element including means for taking up transverse forces during passage of the sliver through said sliver guiding device.

19. The improvement as defined in claim 12, further comprising a frame and a holding element; said pressure sensitive member being positioned between said frame and said first wall element; said holding element pivotally supporting said pressure sensitive member on said frame; further comprising a compensating element for taking up tension forces generated by the running sliver; said compensating element being attached to said first wall element and said frame at a location spaced from said holding element.

20. The improvement as defined in claim 19, wherein said compensating element is a leaf spring.

21. The improvement as defined in claim 19, wherein said compensating element is a rotary joint.

* * * * *